US005601137A

United States Patent [19]

Abe et al.

[11] Patent Number: 5,601,137

[45] Date of Patent: Feb. 11, 1997

[54] CONTINUOUS STEEL PLATE MANUFACTURING FACILITIES

[75] Inventors: Yuji Abe, Yokohama; Shigeki Narishima, Yokosuka; Kinichi Higuchi, Yokohama, all of Japan

[73] Assignee: Ishikawajima-Harima Heavy Industries Co., Ltd., Tokyo, Japan

[21] Appl. No.: 576,348

[22] Filed: Dec. 21, 1995

[30] Foreign Application Priority Data

Jan. 19, 1995 [JP] Japan ..... 7-006111

[51] Int. Cl.[6] ..... B22D 11/12; B21B 1/46; B21B 13/22

[52] U.S. Cl. ..... 164/418; 164/476; 29/527.7; 29/33 C

[58] Field of Search ..... 164/418, 476; 29/527.7, 33 C

[56] References Cited

U.S. PATENT DOCUMENTS

| | | | |
|---|---|---|---|
| 4,998,338 | 3/1991 | Seidel et al. | 164/476 |
| 5,305,515 | 4/1994 | Fastert et al. | 29/527.7 |
| 5,467,518 | 11/1995 | Mertens | 29/527.7 |
| 5,490,315 | 2/1996 | Kostopolos et al. | 29/527.7 |

FOREIGN PATENT DOCUMENTS

| | | |
|---|---|---|
| 0492226 | 7/1992 | European Pat. Off. . |
| 0593002 | 4/1994 | European Pat. Off. . |
| 0648552 | 4/1995 | European Pat. Off. . |
| 3901582 | 8/1990 | Germany . |
| 60-181250 | 12/1985 | Japan . |

*Primary Examiner*—Scott A. Smith
*Assistant Examiner*—I.-H. Lin
*Attorney, Agent, or Firm*—Griffin, Butler, Whisenhunt & Kurtossy

[57] ABSTRACT

The invention provides a continuous steel plate manufacturing facility including continuous casting equipment (12) having a plurality of strands, a plurality of rows of slab conveyers (14) disposed downstream of each of the strands, and a single slab transporting apparatus (16) disposed downstream of the slab conveyers for horizontally transporting slabs from the rows of slab conveyers to a single rolling line disposed downstream of the rows of slab conveyers. A continuous slab casting line defined by the strand and the slab conveyers diagonally intersects, at an intersection point, on the slab transporting apparatus with a slab feeding line (18) which is in communication with the rolling line. The slab transporting apparatus is horizontally swingable about the intersection point (19) between a receiving position A wherein the slab transporting apparatus is disposed on an extension of one of the continuous slab casting lines, and a feed-out position B wherein the slab transporting apparatus is disposed in alignment with the slab feeding line. The present invention provides advantages that slabs can be transported in a short period of time to the single rolling line through a plurality of the continuous casting apparatuses by using a relatively small-sized and small-powered facilities, and that the continuous steel plate manufacturing facility can be combined with three or more continuous casting apparatus.

11 Claims, 5 Drawing Sheets

CONTINUOUS STEEL PLATE MANUFACTURING FACILITIES

BACKGROUND OF THE INVENTION

1. Field of the Invention

The invention relates to a continuous steel plate manufacturing facility comprising continuous casting equipment and a rolling line.

2. Description of the Prior Art

FIG. 1 illustrates an example of continuous casting equipment. Molten steel is introduced through a ladle 30 to a tandish 31, and then supplied to a mold 32 through the tandish 31. The molten steel is cast into a certain shape such as a plate in the mold 32. The thus cast steel plate is rolled downwardly by means of a pair of pinch rolls (not illustrated), and then the thus rolled steel plate is bent and horizontally fed out by means of a plurality of rollers 33. Therefore, the plate is cut by a cutter 34 into slabs having a certain thickness, and subsequently the slabs are horizontally fed out. Usually, a line starting from a ladle to a tandish is called a "machine", while a line from a mold to a point downstream is called a "strand". The continuous casting equipment illustrated in FIG. 1 has a single machine and two strands.

FIG. 2 illustrates an example of a continuous steel plate manufacturing facility comprising a continuous casting apparatus and a rolling line. A slab 35 fed from the continuous casting equipment illustrated in FIG. 1 is reheated in a reheater 36 to a predetermined temperature, and is roughly rolled into a bar 38 in a rough milling machine 37. The bar 38 is again rolled into a strip 40 in a finishing mill 39, and then is wound around a down coiler 41. The continuous steel plate manufacturing facility as mentioned above comprising the continuous casting equipment and the rolling line ensures less consumption energy and a smaller number of processing steps.

FIGS. 3A and 3B are plan views each showing layout of a continuous steel plate manufacturing facility comprising two continuous casting apparatuses including a machine and a strand, and a single rolling line. As illustrated, there has been conventionally used a continuous steel plate manufacturing facility including a plurality of continuous casting apparatuses in communication with a single rolling line in order to enhance operating efficiency of the rolling line. For instance, one of such continuous steel plate manufacturing facilities has been suggested in Japanese Unexamined Utility Model Public Disclosure No. 60-181250, "Continuous Thin Plate Manufacturing Facilities", filed by the assignee of the present application.

FIG. 3A illustrates an example of a continuous steel plate manufacturing facility provided with a reheater including a continuous heater furnace 1 such as a walking furnace. Roller conveyers 2 situated in parallel downstream of continuous casting apparatus CC are spaced away from each other by a certain distance such as about 30 m. At the downstream end of the roller conveyers 2, is disposed a slab-transporter 3 for transversely transporting slabs. The slab-transporter 3 transversely transports slabs fed in parallel from two strands to a feed conveyer 1*a* through which the slabs are to be introduced into the continuous heater furnace 1. The slabs are reheated in the continuous heater furnace 1 while being transversely transported in the continuous heater furnace 1 to a transporting conveyer 1*b*, and then supplied to a rolling line 4. There are cutters 5 disposed on the roller conveyers 2. Reject conveyers 6*a* and 6*b*, for diverting the slabs having been fed on the roller conveyers 2 to the slab-transporter 3, are also disposed on roller conveyors 2.

FIG. 3B illustrates an example of a continuous steel plate manufacturing facility provided with a reheater including a tunnel heater furnace 7. Similarly to the continuous steel plate manufacturing facilities illustrated in FIG. 3A, the roller conveyers 2, which include the tunnel heater furnaces 7, and are situated in parallel, downstream of the continuous casting apparatus CC, are spaced away from each other. At the downstream end of the roller conveyers 2 is disposed a slab-transporter 8 for transversely transporting slabs. The slab-transporter 8 is also provided with the tunnel heater furnace 7. The slab-transporter 8 transversely transports slabs fed in parallel from two strands to a rolling line 4. Thus, the slabs are supplied to the rolling line 4.

However, the above mentioned conventional continuous steel plate manufacturing facility has the problem that the slab-transporters 3 and 8 cannot avoid being quite large in size. Namely, as mentioned earlier, the two continuous casting apparatuses CC are spaced away from each other by a certain distance, for instance, about 30 m. Hence, the slabs have to be transversely transported at least by about 15 m to reach the rolling line 4. In the slab-transporter 3 shown in FIG. 3A, in order to drive roller conveyers provided with the slab-transporter 3, it is necessary to supply electrical power to each of a large number of the rollers, which includes 30 rollers or more, for instance. Thus, about 100 cables have to be transversely transported by about 15 m together with the slab-transporter 3, resulting in the cable bearer having to be quite large in size. In the slab-transporter 8 shown in FIG. 3B, since the tunnel heater furnace has to be transversely transported together with ancillary facilities thereof such as ducts of the heater furnace, fuel and a feeder of a table, the slab-transporter 8 cannot avoid being quite large in size.

There is another problem in the conventional continuous steel plate manufacturing facilities that since the slab-transporters 3 and 8 are large in size, they cannot be transversely moved at high speed, resulting in great temperature reduction of the slabs. Specifically, it takes about one minute for the large-sized slab-transporter 3 to be transversely moved by about 15 m even by a high-powered driver. While the movement of the slab-transporter 3, the temperature of the slabs falls by about 30 degrees, for instance, and thus it takes much time to reheat the slabs and maintain the temperature of the reheated slabs to be homogeneous. Furthermore, much of fuel has to be consumed for reheating the slabs and maintaining the temperature of the slabs homogeneous. On the other hand, the slab-transporter 8 shown in FIG. 3B is able to avoid the temperature fall of the slabs, since the slab-transporter 8 is provided with a heater furnace. However, the slab-transporter 8 has problems that the heater furnace provided makes the continuous steel plate manufacturing facility larger, and facilitates the growth of scales which are difficult to remove.

In addition, since the slab-transporters 3 and 8 take time to transversely move because of their large size, it is difficult to combine the slab-transporter with three or more continuous casting apparatuses, which prevents the enhancement of productivity of the continuous steel plate manufacturing facility.

SUMMARY OF THE INVENTION

In view of the above mentioned problems of conventional continuous steel plate manufacturing facilities, it is an object of the present invention to provide a continuous steel plate manufacturing facility which can transport slabs in a short period of time from a plurality of continuous casting apparatuses to a single rolling line by using a relatively small-sized and small-powered facility, and further can be combined with three or more continuous casting apparatuses.

The invention provides a continuous steel plate manufacturing facility including (a) continuous casting equipment having a plurality of strands for horizontally transporting slabs, (b) a plurality of rows of slab conveyers for conveying slabs each of which rows is arranged in a line continuously downstream of each of the strands for horizontally feeding slabs downstream, which slabs having been transported from each of the strands, and (c) a single slab transporting apparatus, disposed downstream of the rows of slab conveyers, for horizontally transporting slabs from the rows of slab conveyers to a single rolling line disposed downstream of the rows of slab conveyers. Each of the strands and each of the rows of slab conveyers defines a continuous slab casting line which diagonally intersects on the slab transporting apparatus with a slab feeding line which is in communication with the rolling line. The slab transporting apparatus is horizontally swingable about the intersection point between a receiving position A wherein the slab transporting apparatus is disposed on an extension of one of the continuous slab casting lines, and a feed-out position B, wherein the slab transporting apparatus is disposed in alignment with the slab feeding line.

In a preferred embodiment of the present invention, the continuous casting equipment includes a plurality of continuous casting apparatuses each having a single machine and a single strand. A power line and a signal line are preferably connected in the vicinity of the intersection point to the slab feeding apparatus.

The intersection point is situated in the vicinity of downstream end of the slab transporting apparatus. The continuous steel plate manufacturing facility preferably further includes a retractable slab stopper disposed between the downstream end of the slab transporting apparatus and the slab feeding line. The intersection point may be situated in the vicinity of a center of the slab transporting apparatus, in which case the continuous steel plate manufacturing facility preferably further includes a pair of slab stoppers fixed in place and spaced away from each other. The slab stoppers are arranged to be disposed downstream of the slab transporting apparatus when the slab transporting apparatus is in the receiving position A wherein the slab transporting apparatus is in alignment with each of the continuous slab casting lines.

The continuous steel plate manufacturing facilities preferably further includes a swinger for swinging the slab transporting apparatus. For instance, the swinger is composed of a rack and pinion or a hydraulic cylinder.

The continuous steel plate manufacturing facilities may further include a continuous reheater furnace for reheating the slabs while the slabs are transversely transported therein, a feed conveyer for feeding the slabs into the continuous reheater furnace, and a transporting conveyer for transporting the slabs out of the continuous reheater furnace. The feed conveyer is situated on the slab feeding line, and the transporting conveyer is situated on the rolling line. The continuous steel plate manufacturing facilities may further include a plurality of tunnel heater furnaces disposed on the continuous slab casting line, the slab transporting apparatus, and the slab feeding line.

In accordance with the invention having the structure as mentioned above, the continuous slab casting line diagonally intersects on the slab transporting apparatus with a slab feeding line, and the slab transporting apparatus is designed to be horizontally swingable, about the intersection point, between a receiving position A wherein the slab transporting apparatus is disposed on an extension of one of the continuous slab casting lines, and a feed-out position B wherein the slab transporting apparatus is disposed on the slab feeding line. Thus, only by making the slab transporting apparatus swing from the receiving position A to the feed-out position B, it is now possible to transport slabs to a single rolling line through a plurality of continuous casting apparatuses.

Even if a plurality of continuous casting apparatuses have to be spaced away from one another by a relatively long distance such as about 30 m, a plurality of the slab conveyers can be spaced at the downstream ends thereof away from one another by a shorter distance (for instance, about 10 m) than is conventional, since the continuous slab casting line comprising the strand and the slab conveyer diagonally intersects with the slab feeding line leading to the rolling line. Hence, it is possible to shorten swing distance of the slab transporting apparatus, and thus also possible to swing the slab transporting apparatus in a shorter period of time from the receiving position A to the feed-out position B.

The slab transporting apparatus is swingable about the intersection point. Thus, even if it is necessary to provide an electric power source to each of a large number of rollers, the movement distance of the cable can be shortened, and the cable bear can be reduced in size by connecting the power line and signal line to the slab transporting apparatus from the vicinity of the intersection point. In addition, when the slab transporting apparatus is to be provided with the tunnel heater furnace, it is possible to shorten the movement distance of the ancillary facilities of the tunnel heater furnace such as ducts of the heater furnace fuel and a feeder of a table, thereby the slab transporting apparatus being able to be reduced in size.

Thus, it is possible to reduce the slab transporting apparatus and its driver in size, and hence it is also possible to raise their speed of movement resulting in the smaller temperature fall of slabs, reduction of time for reheating and reducing of time for the slabs homogeneous in temperature, and smaller consumption of fuel.

In addition, since the slab transporting apparatus is small in size and needs a small period of time to be transported, the apparatus can be combined with three or more continuous casting apparatus with the result of enhanced productivity of the continuous steel plate manufacturing facilities.

The above and other objects and advantageous features of the present invention will be made apparent from the following description made-with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

Figure 1:
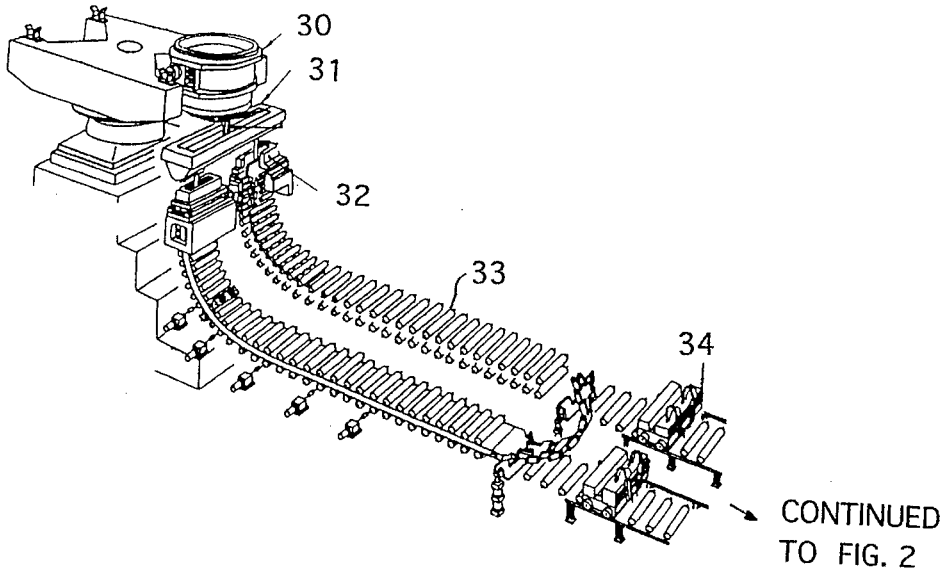
FIG. 1 PRIOR ART
FIG. 1 is a perspective view illustrating continuous casting equipment.
Figure 2:
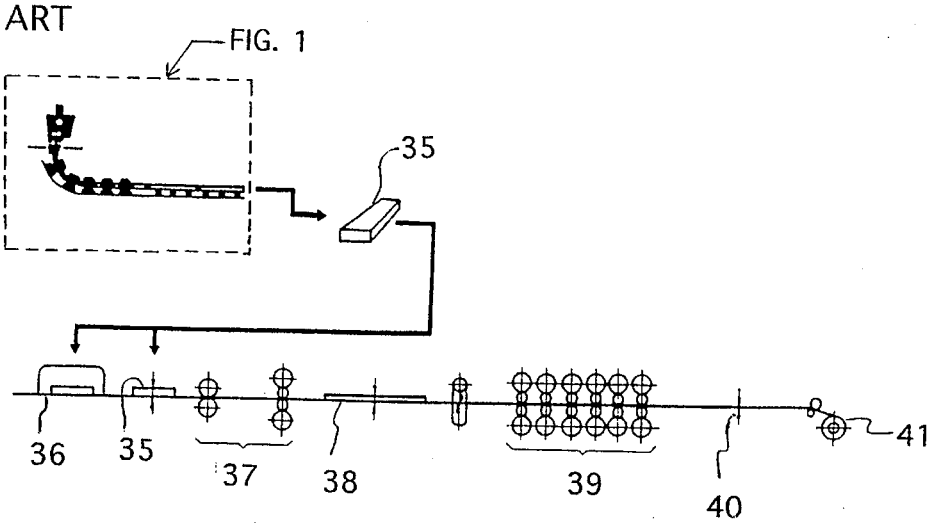
FIG. 2 PRIOR ART
FIG. 2 is a schematic view illustrating the line layout of one continuous steel plate facility comprising continuous casting equipment and a rolling line.
Figure 3A:
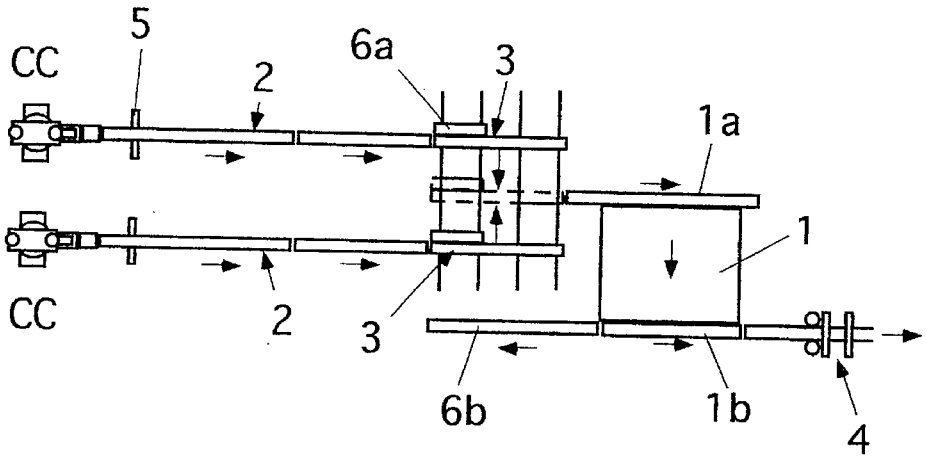
FIG. 3A PRIOR ART
FIG. 3A is a plan view of a continuous steel plate manufacturing facility comprising a rolling line and two continuous casting apparatus having one machine and one strand.
Figure 3B:
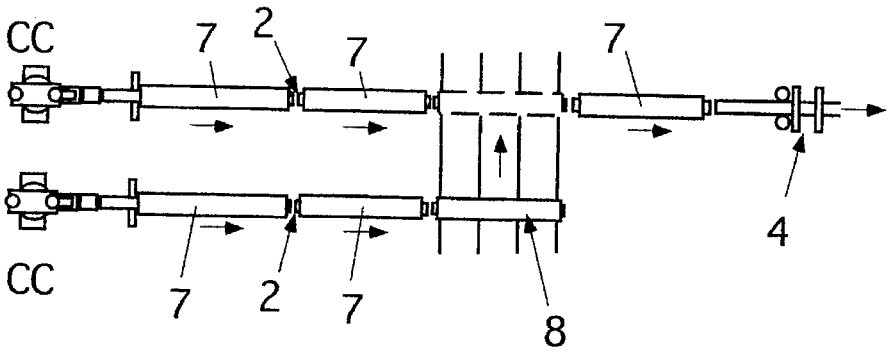
FIG. 3B PRIOR ART
FIG. 3B is a plan view of another continuous steel plate manufacturing facility comprising a rolling line and two continuous casting apparatus having one machine and one strand.
Figure 4:
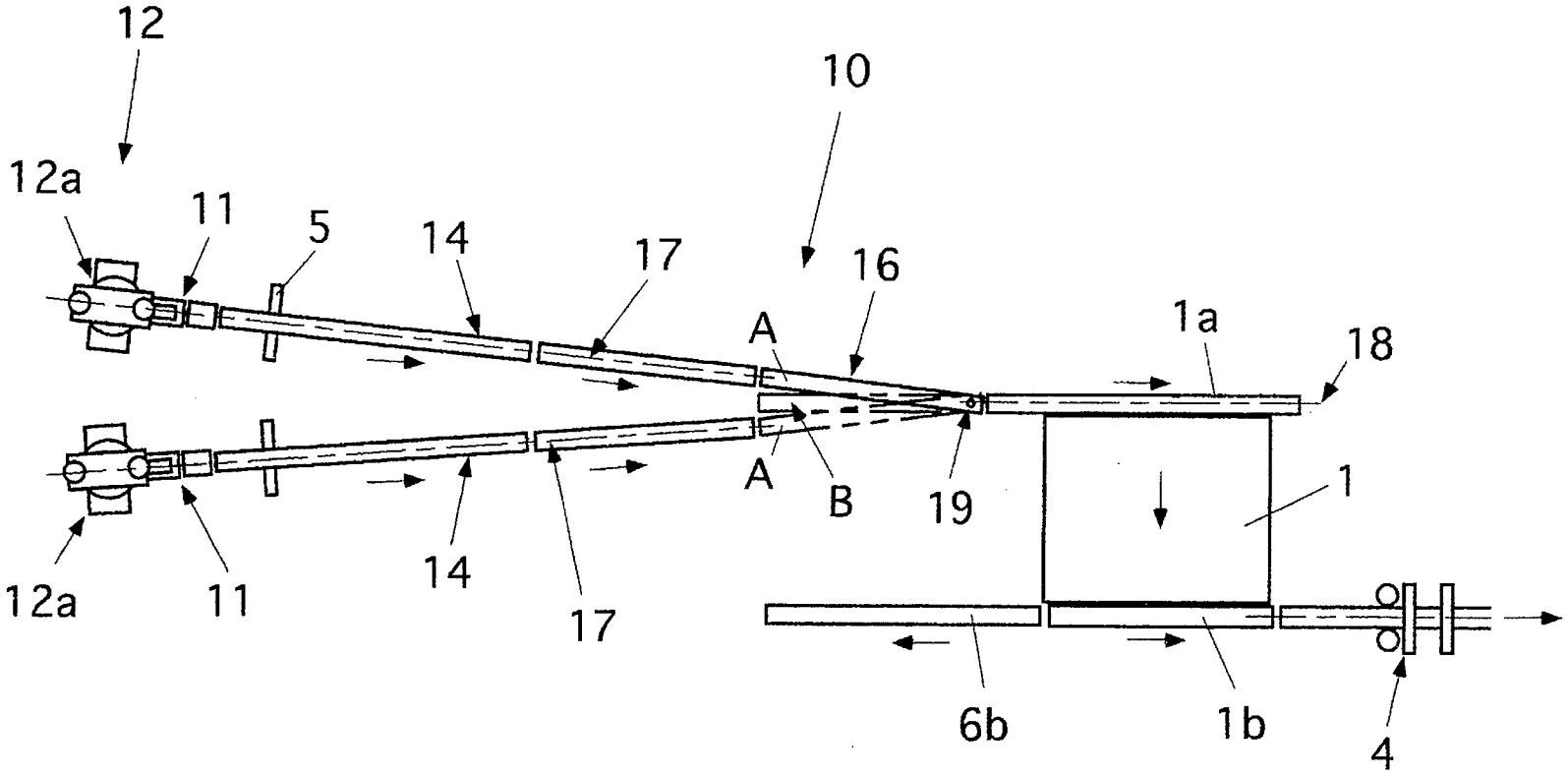
FIG. 4 is a plan view illustrating the layout of the first embodiment of the continuous steel plate manufacturing facility in accordance with the invention.

FIG. 4 illustrates the layout of the first embodiment of the continuous steel plate manufacturing facility in accordance with the invention. The continuous steel plate manufacturing facilities 10 in accordance with the embodiment includes a continuous casting equipment 12 having a plurality of strands 11 for horizontally feeding slabs out, a plurality of rows of slab conveyers 14, and a single slab transporting apparatus 16 situated downstream of the slab conveyers 14.

In the illustrated embodiment, the continuous casting equipment 12 consists of two continuous casting apparatuses 12*a* each having a machine and a strand. However, it should be noted that the continuous casting equipment 12 may comprise a single or a plurality of continuous casting apparatuses having a machine and two strands, or the continuous casting equipment may comprise a single or a plurality of continuous casting apparatuses having three or more strands.

Each of the plurality of rows of slab conveyers 14 is arranged in a line downstream of the each of the strands 11, and horizontally, downstream transports slabs received from the strands 11. The slab conveyers 14 are constructed of, for instance, a plurality of roller conveyers arranged in a line.

In FIG. 4, a continuous slab casting line 17 consisting of the strand 11 and the slab conveyers 14 diagonally intersects on the slab transporting apparatus 16 with a slab feeding line 18 which is in communication with a rolling line through a continuous heater furnace 1. An angle formed by the lines 17 and 18 is determined so that the slab conveyers 14 are spaced away from each other at the downstream ends thereof by a shorter distance (for instance, about 10 m) than before, even if the continuous casting apparatuses 12 have to be spaced away from each other by a long distance (for instance, about 30 m) such as a conventional distance.

The slab transporting apparatus 16 horizontally transports slabs from the slab conveyers 14 to the slab feeding line 18 situated downstream thereof, and hence to the rolling line 1. That is, the slab transporting apparatus 16 is designed to be horizontally swingable about an intersection point 19, at which the continuous slab casting line 17 intersects with the slab feeding line 18, between a receiving position A wherein the slab transporting apparatus 16 is disposed on an extension of one of the continuous slab casting lines 17, and a feed-out position B wherein the slab transporting apparatus 16 is disposed in alignment with the slab feeding line 18.

The continuous steel plate manufacturing facility 10 illustrated in FIG. 4 further includes a continuous reheater furnace 1 for reheating the slabs while the slabs are transversely transported in the reheater furnace 1, a feed conveyer 1*a* for supplying the slabs to the continuous reheater furnace 1, and a transporting conveyer 1*b* for transporting the slabs out of the continuous reheater furnace 1. The feed conveyer 1*a* is situated on the slab feeding line 18 which is in communication with the rolling line 4 through the continuous reheater furnace 1, and the transporting conveyer 1*b* is situated on the rolling line 4.

Figure 5:
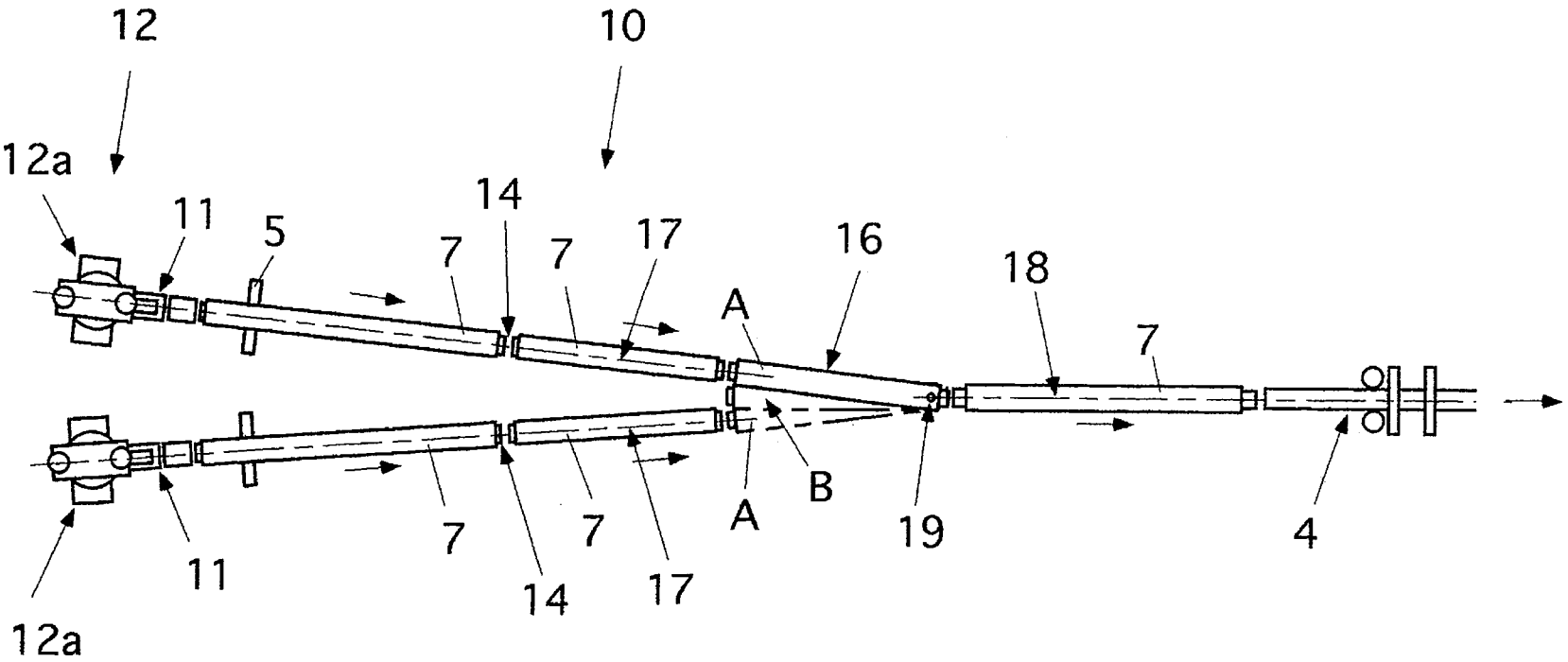
FIG. 5 is a plan view illustrating the layout of the second embodiment of the continuous steel plate manufacturing facility in accordance with the invention.

FIG. 5 illustrates the layout of the second embodiment of the continuous steel plate manufacturing facility in accordance with the invention. The continuous steel plate manufacturing facility 10 in accordance with the embodiment includes a plurality of tunnel heater furnaces 7 disposed on the continuous slab casting line 17, the slab transporting apparatus 16, and the slab feeding line 18. The second embodiment is not provided with the continuous reheater furnace 1, the feed conveyer 1*a* and the transporting conveyer 1*b*, and the slab feeding line 18 is in alignment with the rolling line 4 unlike the first embodiment. The second embodiment has the same structure as that of the first embodiment except those mentioned above.

The continuous steel plate manufacturing facility in accordance with the second embodiment makes it possible to transport slabs to the single rolling line 4 through a plurality of the continuous casting apparatuses 12 only by swinging the slab transporting apparatus from the receiving position A to the feed-out position B. Even if a plurality of the continuous casting apparatus 12 have to be spaced away from one another by a longer distance than is conventional, such as about 30 m, a plurality of the slab conveyers 14 can be spaced at the downstream ends thereof away from one another by a shorter distance than is conventional, such as about 10 m, since the continuous slab casting line 17 comprising the strand 11 and the slab conveyer 14 diagonally intersects with the slab feeding line 18 leading to the rolling line 4. Hence, it is possible to shorten a swing distance of the slab transporting apparatus 16, and thus also possible to swing the slab transporting apparatus 16 in a shorter period of time (for instance, about 20 seconds) from the receiving position A to the feed-out position B to transport the slabs to the rolling line 4.

Figure 6A:
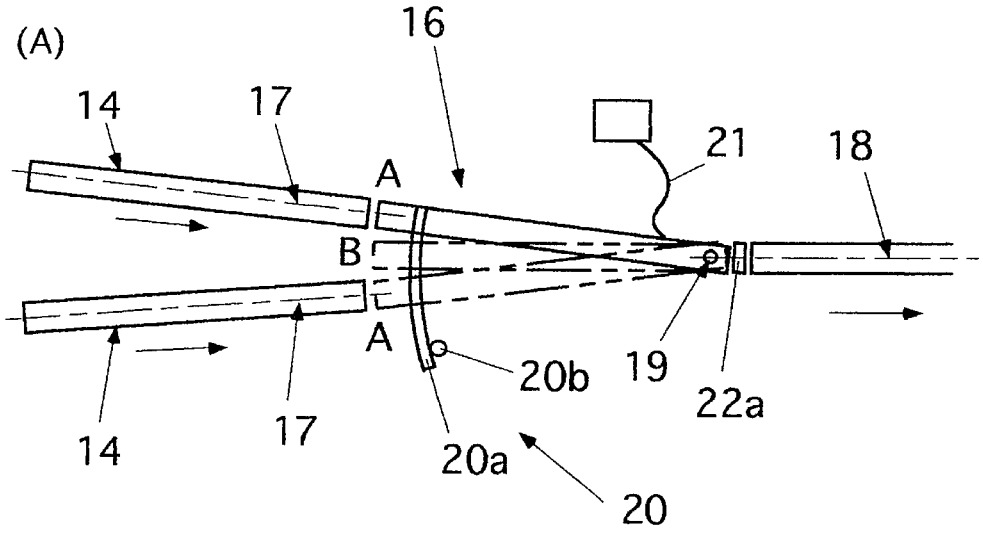
FIG. 6A is an enlarged plan view illustrating the layout of the slab transporting apparatus included in the continuous steel plate manufacturing facility illustrated in FIG. 4.

FIG. 6A is an enlarged plan view of the slab transporting apparatus 16 illustrated in FIG. 4. As illustrated, the intersection point 19 is situated in the vicinity of the downstream end of the slab transporting apparatus 16. The slab transporting apparatus 16 is swung by a swinger 20 comprising a movable rack 20*a* and a stationary pinion 20*b*. By rotating the pinion 20*b* by a driver (not illustrated), the slab transporting apparatus 16 can be swung between the receiving position A and the feed-out position B.

A power and signal line 21 is connected in the vicinity of the intersection point 19 to the slab transporting apparatus 16. Thus, even if it is necessary to provide an electric power source to each of a large number of rollers, the movement distance of the cable can be shortened, and the cable bearer can be reduced in size or can be made no longer necessary.

As illustrated in FIG. 6A, a retractable slab stopper 22*a* is provided between the downstream end of the slab transporting apparatus 16 and the slab feeding line 18. The slab stopper 22*a* has a projection above the slab conveyers 14 so that slabs are prevented from being fed downstream when the slab transporting apparatus 16 is in the receiving position A. When the slab transporting apparatus 16 is in the feed-out position B, the projection of the slab stopper 22*a* is lowered below the slab conveyers 14. Thus, even when the roller conveyer of the slab transporting apparatus 16 and so on is insufficiently controllable, it is possible to avoid overrun of the slabs.

Figure 6B:
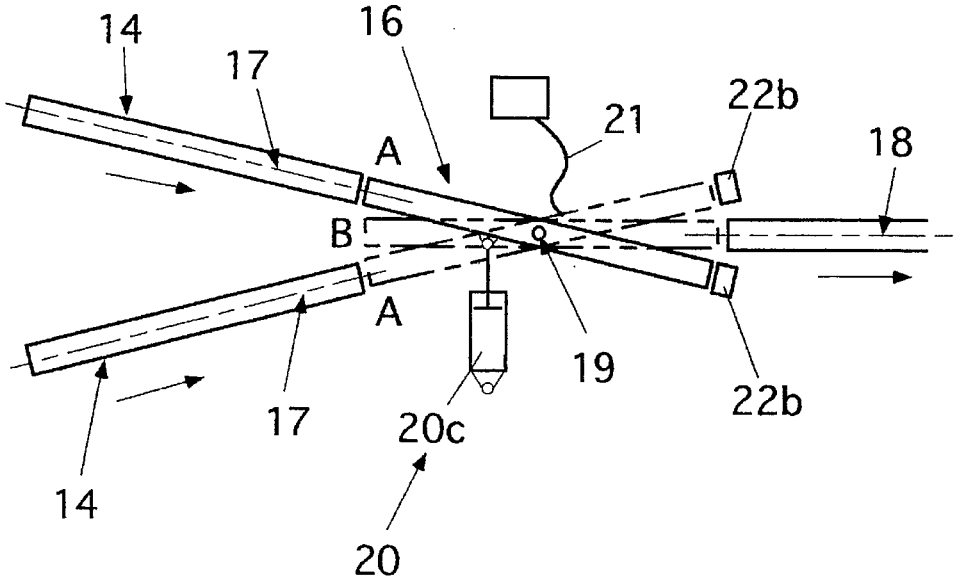
FIG. 6B is an enlarged plan view illustrating the layout of another slab transporting apparatus.

FIG. 6B illustrates another slab transporting apparatus 16. In this apparatus 16, the intersection point 19 is arranged to be situated in the vicinity of the center of the slab transporting apparatus 16. The driver 20 comprises a stationary hydraulic cylinder 20*c*. The slab transporting apparatus 16 is swung between the receiving position A and the feed-out position B as the hydraulic cylinder 20*c* extends or contracts. The slab transporting apparatus 16 illustrated in FIG. 6B is provided with a pair of slab stoppers 22*b* which are fixed in place and spaced away from each other. The slab stoppers 22*b* are arranged to be disposed downstream of the slab transporting apparatus 16 when the slab transporting apparatus 16 is in the receiving position A wherein the slab transporting apparatus 16 is in alignment with each of the continuous slab casting lines 17. The slab stoppers 22*b* prevent the overrun of the slabs, similarly to the slab stopper 22*a*. The slab transporting apparatus 16 illustrated in FIG. 6B has the same structure as that of the slab transporting apparatus illustrated in FIG. 6A except the above mentioned differences.

In the above mentioned embodiments, the slab transporting apparatuses 16 illustrated in FIGS. 6A and 6B are applied to the continuous steel plate manufacturing facility illustrated in FIG. 4, however, it should be noted that the slab transporting apparatuses 16 illustrated in FIGS. 6A and 6B may be applied to the continuous steel plate manufacturing facilities illustrated in FIG. 5, in which case, it is possible to shorten a movement distance of ducts of the heater furnace, fuel, a feeder of a table and so on, and to reduce the continuous steel plate manufacturing facilities in size.

In accordance with the present invention, it is now possible to transport slabs to the single rolling line through a plurality of the continuous casting apparatuses only by making the slab transporting apparatus to swing from the receiving position A to the feed-out position B. In addition, even if a plurality of the continuous casting apparatuses have to be spaced away from one another by a relatively long distance such as about 30 m, a plurality of the slab conveyers can be spaced at the downstream ends thereof away from one another by a shorter distance (for instance, about 10 m) than conventional. Hence, it is possible to shorten a swing distance of the slab transporting apparatus, and thus also possible to swing the slab transporting apparatus in a shorter period of time from the receiving position A to the feed-out position B.

As mentioned earlier, the slab transporting apparatus is swingable about the intersection point. Thus, even if it is necessary to provide an electric power source to each of a large number of rollers, the movement distance of the cable can be shortened, and the cable bearer can be reduced in size by connecting the power line and signal line to the slab transporting apparatus in the vicinity of the intersection point. In addition, when the slab transporting apparatus is to be provided with the tunnel heater furnace, it is possible to shorten the movement distance of the ancillary facilities of the tunnel heater furnace such as ducts of the heater furnace, fuel and a feeder of a table, thereby the slab transporting apparatus being able to be reduced in size.

Thus, it is possible to reduce the slab transporting apparatus and a driver therefor in size, and hence it is also possible to raise their speed of movement resulting in the smaller temperature fall of slabs, reduction of time for reheating and reduction of time for the slabs to be homogeneous in temperature, and smaller consumption of fuel. In addition, since the slab transporting apparatus is small in size and needs a small period of time for transporting, the slab transporting apparatus can be combined with three or more continuous casting apparatuses with the result of enhanced productivity of the continuous steel plate manufacturing facility.

As is obvious from the description having been made so far, the present invention provides advantages that slabs can be transported in a short period of time to a single rolling line through a plurality of continuous casting apparatuses by using a relatively small-sized and small-powered facility, and that the continuous steel plate manufacturing facilities can be combined with three or more continuous casting apparatuses.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A continuous steel plate manufacturing facility comprising:

continuous casting equipment having a plurality of strands for horizontally transporting slabs;

a plurality of rows of slab conveyers for conveying slabs downstream from said strands, each of which rows is arranged in a line continuously downstream of each of said strands; and a single slab transporting apparatus, disposed downstream of said rows of slab conveyers, for horizontally transporting slabs from said rows of slab conveyers to a single rolling line disposed downstream of said rows of slab conveyers, each of said strands and each of said rows of slab conveyers defining a continuous slab casting line which diagonally intersects, at an intersection point, on said slab transporting apparatus with a slab feeding line in communication with said rolling line, said slab transporting apparatus being horizontally swingable about the intersection point between a receiving position A, wherein said slab transporting apparatus is disposed on an extension of one of said continuous slab casting lines, and a feed-out position B, and wherein said slab transporting apparatus is disposed in alignment with said slab feeding line.

2. The continuous steel plate manufacturing facility as set forth in claim 1, wherein said continuous casting equipment comprises a plurality of continuous casting apparatuses each having a single machine and a single strand.

3. The continuous steel plate manufacturing facility as set forth in claim 1, wherein a power line and a signal line are connected, in the vicinity of said intersection point, to said slab feeding apparatus.

4. The continuous steel plate manufacturing facility as set forth in claim 1, wherein said intersection point is situated in the vicinity of downstream end of said slab transporting apparatus.

5. The continuous steel plate manufacturing facility as set forth in claim 4, further comprising a retractable slab stopper disposed between a downstream end of said slab transporting apparatus and said slab feeding line.

6. The continuous steel plate manufacturing facility as set forth in claim 1, wherein said intersection point is situated in the vicinity of a center of said slab transporting apparatus.

7. The continuous steel plate manufacturing facility as set forth in claim 6, further comprising a pair of slab stoppers fixed in place and spaced away from each other, said slab stoppers being arranged to be disposed downstream of said slab transporting apparatus when said slab transporting apparatus is in said receiving position A wherein said slab transporting apparatus is in alignment with each of said continuous slab casting lines.

8. The continuous steel plate manufacturing facility as set forth in claim 1, further comprising a swinger for swinging said slab transporting apparatus.

9. The continuous steel plate manufacturing facilities as set forth in claim 8, wherein said swinger comprises a rack and pinion or a hydraulic cylinder.

10. The continuous steel plate manufacturing facility as set forth in claim 1, further comprising: a continuous reheater furnace for reheating said slabs while said slabs are transversely transported therein; a feed conveyer for feeding said slabs into said continuous reheater furnace; and a transporting conveyer for transporting said slabs out of said continuous reheater furnace, said feed conveyer being situated on said slab feeding line, and said transporting conveyer being situated on said rolling line.

11. The continuous steel plate manufacturing facility as set forth in claim 1, further comprising a plurality of tunnel heater furnaces disposed on said continuous slab casting line, said slab transporting apparatus, and said slab feeding line.

* * * * *